US005196863A

United States Patent [19]

Palmer et al.

[11] Patent Number: 5,196,863

[45] Date of Patent: Mar. 23, 1993

[54] PLATEN PROTECTING BORDERLESS THERMAL PRINTING SYSTEM

[75] Inventors: Joseph P. Palmer, Batavia; Terrence L. Fisher, Sr., Rochester, both of N.Y.

[73] Assignee: Eastman Kodak Company, Rochester, N.Y.

[21] Appl. No.: 846,098

[22] Filed: Mar. 5, 1992

[51] Int. Cl.[5] ..... B41J 2/325

[52] U.S. Cl. ..... 346/76 PH; 400/120

[58] Field of Search ..... 346/76 PH; 400/120

[56] References Cited

U.S. PATENT DOCUMENTS 4,738,555 4/1988 Nagashima ..... 346/76 PH
4,815,872 3/1989 Nagashima ..... 346/76 PH
4,966,464 10/1990 Matoushek ..... 346/76 PH

*Primary Examiner*—Benjamin R. Fuller
*Assistant Examiner*—Huan Tran
*Attorney, Agent, or Firm*—Raymond L. Owens

[57] ABSTRACT

A platen protecting thermal printing system effects borderless printing on an image receiver by thermal transfer of image imparting substance such as diffusible or sublimable dye from a donor web at a printing nip between coextensive portions of a thermal head and cooperating platen defining a nip width. The web is disposed between the head and receiver, and a platen protecting extension member is disposed between the receiver and platen, for common travel of the web, receiver and member through the nip during printing. The web width exceeds the receiver width and exceeds, equals or is exceeded by the nip width. The member width exceeds the nip width when the web width exceeds or equals the nip width, and exceeds the web width when the nip width exceeds the web width. The member is overprinted on its lateral portions extending beyond the receiver side edges within the range of the web width and/or nip width, while preventing overprinting on the platen.

9 Claims, 3 Drawing Sheets

PLATEN PROTECTING BORDERLESS THERMAL PRINTING SYSTEM

CROSS-REFERENCE TO RELATED PATENT APPLICATION

This patent application is related to U.S. patent application Ser. No. 846,107, by Terrence L. Fisher, Sr., which is being filed simultaneously herewith and has a common assignee and one common inventor with this patent application, and which is entitled "APPARATUS AND METHOD FOR PROTECTING A FUSER ROLLER".

FIELD OF THE INVENTION

This invention relates to a platen protecting borderless thermal printing system, including a borderless image thermal printing assembly and its method of operation.

BACKGROUND OF THE INVENTION

In certain thermal printers, a thermal head having a linear array of individually energizable, e.g., resistive, heating elements is modulated (energized) to transfer heat transferable (e.g., thermally diffusible or sublimable) image imparting substance such as dye from a donor web (dye web, carrier) to an image receiver (sheet, medium) such as recording paper, for borderless printing, i.e., to print images across the full width of the receiver from one side edge to the other, by known technique.

The dye is imparted from the web to the receiver as image pixels, e.g., of 0.003 inch length and 0.003 inch height, by action of the individual heating elements. Each pixel constitutes a dye deposit on the receiver at a pixel position corresponding to a heating element. The density (darkness) of a printed dye pixel on the receiver is a function of the temperature of the heating element and the time it heats the web. Since the heat delivered by a heating element to the web causes dye transfer to the receiver as an image pixel, the dye amount transferred as a pixel is directly related to the heating element energy amount delivered to the web. The operation is controlled to achieve uniform print density.

Typically, a rotatable platen (drum) forms a printing nip with the head through which the web and receiver travel in unison as the platen rotates while the head remains stationary. The platen supports the receiver and the web is situated between the receiver and head. The head urges the web and receiver against the platen under mechanical contact force during printing for efficient dye transfer from the web to the receiver. The contact force must be uniform to avoid variation in the energy delivered by the heating elements to the web as this causes print density non-uniformity.

The linear array of heating elements defines a head printing width which for borderless printing should exceed the receiver width so as to overlap the receiver side edges to assure printing of the full receiver width in each printed line, i.e., without leaving unprinted side borders on the line. For the same reason, the web width should exceed the receiver width. The platen width should also exceed the receiver width for adequate support of the receiver. Whether the platen width exceeds, equals or is exceeded by the head printing width, the platen should form a printing nip with the head that defines a nip width along their common extent likewise exceeding the receiver width.

The individual heating elements are energized under control of borderless printing software in known manner for dye transfer from the web to the receiver as image pixels so as to assure that the pixels are imparted selectively throughout each line of printing across the width of the receiver at every pixel position from the first pixel position at its left edge to the last pixel position at its right edge. The software must control the borderless printing within precise width limits to avoid leaving an unprinted border of even a single pixel at either side edge of the receiver.

The software should also avoid overprinting at the receiver side edges, i e., printing one or more pixels on the adjacent portions of the platen. Normally, the software precisely repeatably controls the start of a printing line at the first pixel position at the receiver left edge. However, precisely repeatable stopping of the printing at the last pixel position at the receiver right edge usually requires special software for "a stop printing line" control. Use of less elaborate software that effects platen overprinting to assure borderless receiver printing, objectionably contaminates the platen with pixel dye deposits.

Aside from the basic drawback of dye contamination build up on the platen, upon changing to a wider receiver, the dye deposits around the platen circumference in the vicinity of the narrower receiver side edges will lie under the wider receiver side edges, making them uneven and the printing nip non-uniform. The deposits are random solid masses of heat transferable dye, i.e., thermally diffusible or sublimable substance, unlike liquid ink which spreads as an even film under capillary and surface tension forces.

The contaminated platen surface changes locally in nip distance from the heating elements along the nip Width and around the platen circumference in the vicinity of the randomly deposited dye pixels. This local nonuniformity disturbs the uniformity of the mechanical contact force between the head and the web and receiver and thus the uniformity of the dye amount transferred as a function of the energy delivered by the heating elements under such contact force. The density of the printed dye image pixels is thereby rendered non-uniform at the receiver side edges.

Even where elaborate software control of borderless printing is used with an arrangement in which the printing nip and receiver, and possibly also the web, have the same width, to avoid platen overprinting, the dimensional tolerances of such widths are such that physical misalignments can occur. These misalignments can cause platen overprinting despite elaborate software use.

As the head is usually a permanent part of the printer, when switching from a narrower to a wider receiver, the overprinted platen must be replaced to avoid the above problems. The fresh platen must form with the head a printing nip of proper width, as defined by their common extent, to accommodate the wider receiver, i.e., the new nip width must equal or exceed the receiver width. Taping the platen circumference adjacent the receiver side edges with masking tape to offset the overprinting problem, instead of replacing the platen, merely introduces a further source of dimensional non-uniformity and unevenness at the printing nip.

Another problem is that the platen dye deposits can build to a height sufficient under the mechanical contact force at the nip to disturb the functioning of the adjacent heating elements. If the nip width exceeds the web width, dye deposits on the rotating platen can wipe against the heating elements to contaminate and possibly misalign them, and render their efficiency nonuniform. If the web width equals or exceeds the nip width, similar action can occur through the web. If the receiver is replaced by a wider one, like action can occur through both the receiver and web.

Current borderless printing practice is thus relegated to enduring the non-uniformity problems of platen overprinting, or of platen replacement or taping to offset such problems. Of course, on switching from one width receiver to another, the software must be changed to control the new borderless printing width.

In certain single color thermal printers, a single color dye web is used to print image pixels on the receiver. In certain multicolor printers, the web has a repeating series of successive dye areas of different colors, e.g., yellow, magenta and cyan, and the receiver is conducted repeatedly past the head to transfer dye from each color area of the series in turn to the same print area of the receiver, i.e., on reregistering it each time with the head.

Various wet printer, masking device and thermal printer arrangements are known. Examples of such arrangements are shown in the following prior art.

British Patent No. 1,655 (Godchaux & Cie.) discloses a printer using liquid ink for wet printing of both sides of a sheet. On passing the sheet between a first inking roller and first pressure roller to print its first side, it is passed between a second inking roller and second pressure roller to print its second side. An ink absorbing web is located between the second pressure roller and printed first side of the sheet to prevent the ink on the first side from wetting the second pressure roller.

U.S. Pat. No. 849,454 (Beeken) discloses a printer using liquid ink for wet printing of both sides of a sheet by separate inking rollers at diametrically opposed parts of a blanket covered pressure roller. The sheet passes along one part of the pressure roller to print its first side by a first inking roller, and then is twisted and passed along the other pressure roller part to print its second side by a second inking roller. A roll-tympan web is located between the blanket and sheet to receive the offset (ink) from the printed first side of the sheet.

British Patent No. 235,545 (Koechlin S. A.) discloses a printer using liquid ink for wet printing of fabric passed between an inking roller and pressure roller. The fabric is separated from the inking roller by an endless cloth band and a wire gauze band.

U.S. Pat. Nos. 1,287,524 and 1,700,865 (Trier) disclose a printer using liquid ink for wet printing of both sides of a sheet. After printing the first side, the second side is printed by passing the sheet between an inking roller and pressure roller covered by a web to receive the offset (ink) from its first side.

U.S. Pat. No. 1,873,207 (Knowlton) discloses a printer using liquid ink for wet printing of both sides of a sheet. A cover or belt on a pressure roller receives the offset (ink) from the first side of the sheet during printing of its second side.

U.S. Pat. No. 2,175,051 (Bromley) discloses a printer using liquid ink for wet printing of fabric passed between an inking roller and pressure roller. The fabric is separated from the pressure roller by an inner blanket and an outer blotting web.

British Patent Specification No. 715,021 (Verduin) discloses a printer using wet ink for wet printing of fabric passed between multiple color stations and a single pressure roller. The fabric is separated from the pressure roller by a blanket.

U.S. Pat. No. 4,478,878 (Neuwald) discloses the forming of a metal-free strip on insulating tape used in an electrical capacitor. A strip area on the insulating tape is covered by masking tape, a metal coating is deposited thereon, and then the masking tape is removed to leave the metal-free strip.

U.S. Pat. No. 4,571,102 (Ono et al.) discloses an apertured masking frame for mounting a dot matrix printer ribbon.

U.S. Pat. No. 4,904,098 (Hamilton) discloses an apertured flexible masking shield for the print wheel of an impact printer.

U.S. Pat. No. 4,929,102 (Mizutani) discloses an apertured mask for the ribbon of a mechanical print head pin type printer.

U.S. Pat. No. 4,919,555 (Kikuchi) discloses a thermal printer with adjustable axis mounting means used to print adhesive backed labels carried on a support sheet traveling in unison with a carbon printing ribbon through the printing nip between the thermal head and platen (drum). In the embodiment shown, the head, platen, printing nip, ribbon, labels and support sheet, all have the same width. Borderless printing is not contemplated.

It is desirable to provide a thermal printing assembly having a thermal head and platen defining a printing nip for borderless printing of different width image receivers using a corresponding donor web, while preventing lateral overprinting on the platen, without the need for elaborate or special software.

SUMMARY OF THE INVENTION

The foregoing drawbacks have been obviated by providing a thermal printing system for borderless printing, in which an extension member is disposed between the image receiver and platen, having a wider width than the receiver and sufficient to protect the platen portions extending beyond the receiver side edges from lateral overprinting by receiving such overprinting thereon.

The platen protecting borderless thermal printing system of the present invention contemplates a thermal printing assembly and cognate operating method for printing images across the width of an image receiver from one side edge to the other side edge thereof.

According to one aspect of the invention, a printing assembly is provided, which comprises a thermal printing head, a cooperating platen, an image receiver and a donor web, plus an extension member for protecting the platen from overprinting thereon.

The head has a linear array of energizable heating elements, and the platen is arranged to form a printing nip with the head defining a nip width along their common extent. The receiver has a width smaller than the nip width and is arranged to travel through the nip within the lateral confines of the nip width. The web contains heat transferable image imparting substance, and has a width larger than the receiver width and sufficient to occupy at least a portion of the nip width. The web is arranged to travel through the nip between the head and receiver with its sides extending laterally beyond the receiver sides in facing relation to the platen and so as to occupy at least a portion of the nip width.

The extension member has a width larger than the receiver width and sufficient to exceed the extent of the nip width occupied by the web. The extension member is disposed at the nip between the receiver and platen with its sides extending laterally beyond the receiver sides and correspondingly beyond the extent of the nip width occupied by the web. Borderless printing can thus be effected via the head and web on the receiver with lateral overprinting on the extension member adjacent the receiver sides while preventing lateral overprinting on the platen.

According to one feature, the web width is at least as large as the nip width and the extension member width exceeds the nip width. According to another feature, the web width is smaller than the nip width and the extension member width exceeds the web width.

Typically, the extension member is arranged to travel through the nip. In particular, the receiver, web and extension member are arranged to travel in unison through the nip to effect the printing and overprinting. The receiver, web and extension member are preferably provided as longitudinal elements.

More specifically, the heating elements define a printing width, and the platen forms a printing nip with the head printing width which defines the nip width along their common extent.

In one form, the receiver width is smaller than the nip width, and the web width is larger than the receiver width and at least as large as the nip width. The web is arranged to travel through the nip with its sides extending laterally beyond the receiver sides and so as to occupy substantially completely the nip width. The extension member width is larger than the receiver width and nip width, and it is disposed at the nip with its sides extending laterally beyond the receiver sides and correspondingly beyond the nip width confines.

In another form, the receiver width is smaller than the nip width, and the web width is larger than the receiver width and smaller than the nip width. The web is arranged to travel through the nip with its sides extending laterally beyond the receiver sides and so that the sides of the nip width extend correspondingly beyond its sides. The extension member width is larger than the receiver width and web width, and it is disposed at the nip with its sides extending laterally beyond the receiver sides and correspondingly beyond the web sides.

According to another aspect of the invention, a cognate method of borderless thermal printing is provided for printing images across the width of an image receiver from one side edge to the other side edge thereof. The method comprises providing the above stated thermal printing assembly of such head, platen, image receiver, donor web, and extension member, and effecting via the head and web borderless printing on the receiver and lateral overprinting on the extension member adjacent the sides of the receiver while preventing lateral overprinting on the platen.

The invention will be more readily understood from the following detailed description taken with the accompanying drawings and claims.

It is noted that the drawings are not to scale, some portions being shown exaggerated to make the drawings easier to understand.

DETAILED DESCRIPTION

Figure 1:
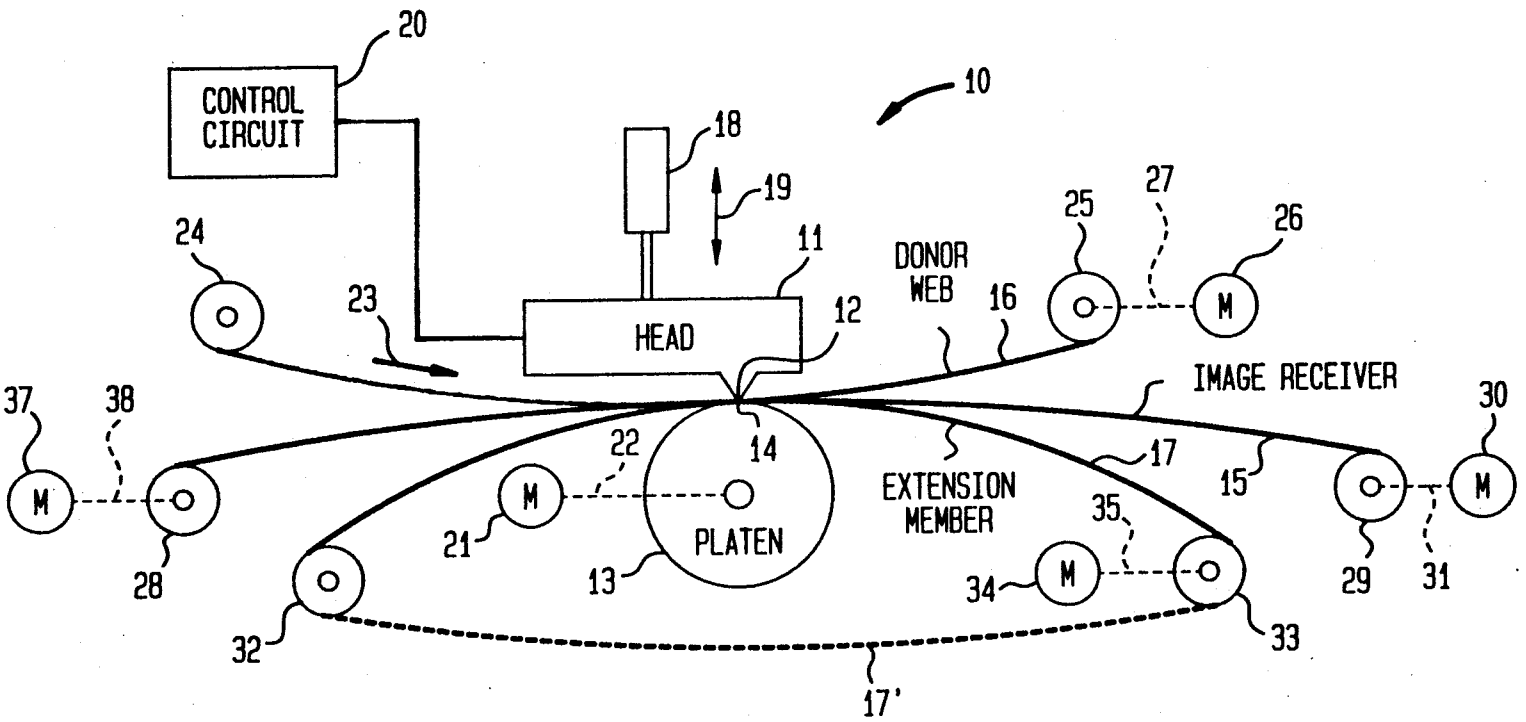
FIG. 1 is a side view of an assembly for borderless thermal printing from a donor web onto an image receiver while preventing overprinting on the receiver supporting platen, in accordance with a first embodiment of the invention.
Figure 2:
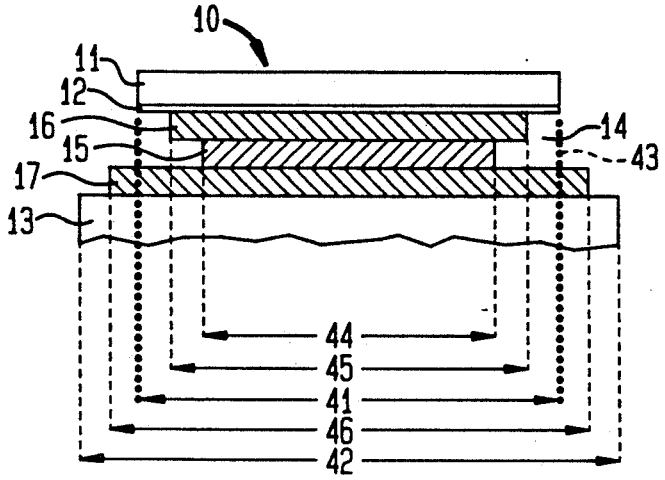
FIG. 2 is a partial sectional view of the assembly of FIG. 1 showing the differential widths of the pertinent parts.
Figure 3:
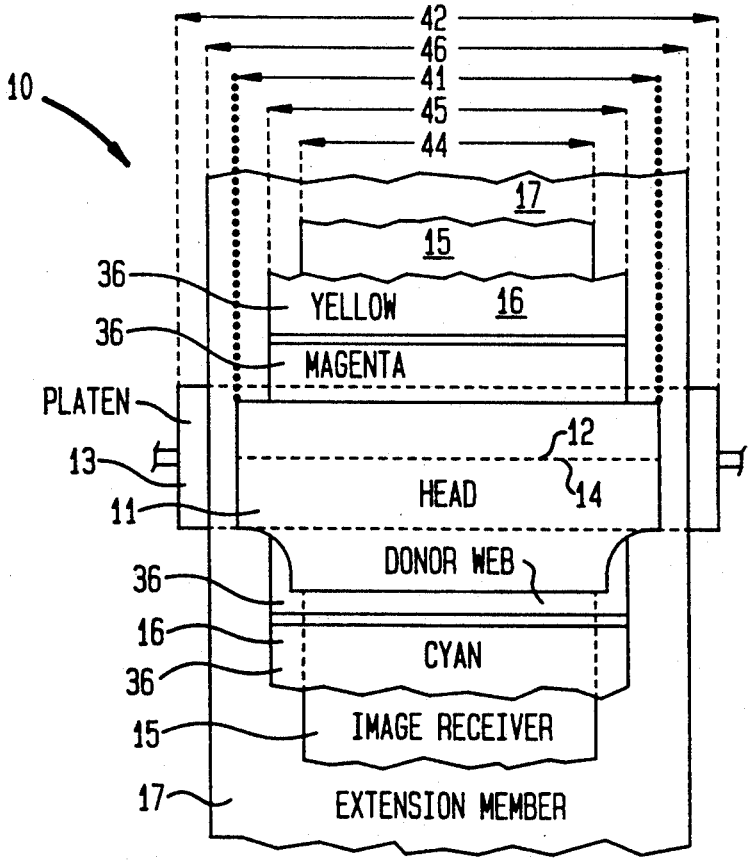
FIG. 3 is a partial top view of the assembly of FIG. 1 showing the disposition of such parts.

Referring now to FIGS. 1 to 3, there is shown a borderless thermal printing assembly 10 for printing images across the width of an image receiver from one side edge to the other side edge thereof in accordance with a first embodiment of the invention. Assembly 10 has a thermal printing head 11, bead of heating elements 12, platen 13, printing nip 14, image receiver 15, donor web 16, extension member 17 or modified member 17', solenoid 18, transverse path 19, control circuit 20, platen motor 21 and linkage 22, longitudinal path 23, web reels 24 and 25, web motor 26 and linkage 27, receiver reels 28 and 29, receiver motors 30 and 37 and linkages 31 and 38, member reels 32 and 33, member motor 34 and linkage 35, color frames 36, and widths 41, 42, 43, 44, 45 and 46.

Except for extension member 17, or modified member 17', and reels 32 and 33, motor 34 and linkage 35, according to the invention, assembly 10 comprises a conventional thermal printer.

Assembly 10 comprises a multicolor printer having a thermal printing head 11 with a plurality of heating elements, shown as a bead of elements 12, and a rotatable platen (drum) 13 arranged to form a printing nip 14 with head 11. Elements 12 are energizable in known manner per control circuit 20 to generate images on a responsive imaging material, and thus to print images of different colors, e.g., yellow, magenta and cyan, respectively, from sets of successive frames 36 of a donor web (dye web) 16, in superimposed relation on the same area of each successive portion of an image receiver 15, e.g., a paper sheet such as of recording paper, in a printing run.

Head 11 is connected to a solenoid 18 for movement along a transverse path indicated by arrow 19, between a spaced position and a contact position relative to platen 13. In the contact position, head 11 forms nip 14 with platen 13, e.g., under slight compression (mechanical contact force), along the common extent of the bead (linear array) of heating elements 12 and platen 13.

Receiver 15 is fed from a supply reel 28 to a takeup reel 29, driven by a motor 30 via a drive linkage 31 (shown schematically in FIG. 1), for forward travel along a longitudinal path indicated by the arrow 23 through nip 14. Receiver 15 is fed from takeup reel 29 to supply reel 28, driven by a motor 37 via a drive linkage 38 (shown schematically in FIG. 1), for reverse travel through nip 14. When motor 30 is operated for forward movement of receiver 15 from supply reel 28 to takeup reel 29, motor 37 is disengaged, and when motor 37 is operated for reverse movement of receiver 15 from takeup reel 29 back to supply reel 28, motor 30 is disengaged.

However, motors 30 and 37 may be reversible motors arranged for common operation at concordant speed in forward direction, and in reverse direction, for such movement of receiver 15.

Web 16 is fed from a supply reel 24 to a takeup reel 25, driven by a motor 26 via a drive linkage 27 (shown schematically in FIG. 1), for forward travel along path 23 through nip 14 in unison with receiver 15, being interposed between head 11 and receiver 15. Web motor 26 is arranged for common operation with receiver motor 30 and at concordant speed for uniform forward movement of web 16 and receiver 15 in unison. Web motor 26 is disengaged along with receiver motor 30 when receiver motor 37 is operated.

Where receiver motors 30 and 37 are reversible motors, web motor 26 is arranged for common operation therewith at concordant speed for uniform forward movement of web 16 and receiver 15 in unison, and is disengaged when receiver motors 30 and 37 operate for reverse movement of receiver 15.

Platen 13 is driven by a reversible motor 21 via drive linkage 22 (shown schematically in FIG. 1), and supports receiver 15 at nip 14. Platen 13 is driven by motor 21 in forward direction in coordination with the driving of takeup reel 29 by receiver motor 30 and takeup reel 25 by web motor 26, to convey receiver 15 and web 16 in unison along path 23 for uniform forward travel through nip 14 to print images of one color on an area of receiver 15 from a frame 36 of web 16 on energizing head 11 in a printing cycle.

Platen 13 is driven by motor 21 in reverse direction in coordination with the driving of supply reel 28 by receiver motor 37, to convey receiver 15 along path 23 for reverse travel through nip 14 to reregister with nip 14 the area of receiver 15 printed with a color from a frame 36 of web 16 in a preceding cycle, for printing the next color on the same area from the next frame 36 of a set of successive color frames in the next cycle in known manner.

Platen 13 and reels 29 and 27 are driven in concordantly controlled manner by motors 21, 30 and 26 and linkages 22, 31 and 27 for forward travel of receiver 15 and web 16. For return travel of receiver 15, platen 13 and reel 28 are driven in concordantly controlled manner by motors 21 and 37 and linkages 22 and 38. Where receiver motors 30 and 37 are reversible motors, platen 13 and motors 30 and 37 are driven in concordantly controlled manner for such forward travel of receiver 15 and web 16, and correspondingly for such reverse travel of receiver 15.

Platen motor 21, web motor 26 and receiver motors 30 and 37 are typically stepper motors. Instead of providing motors 21, 30 and/or 37 as reversible motors, the corresponding linkages 22, 31 and/or 38 may be provided with conventional gearing to shift between forward and reverse direction operation.

Solenoid 18, platen motor 21, web motor 26 and receiver motors 30 and 37 are connected to control circuit 20 (by means not shown) for concordant successive and simultaneous operation, as the case may be, in known manner. Any other means may be used to move head 11 between spaced and contact positions, and receiver 15 and web 16 in unison in forward direction through nip 14, and receiver 15 in reverse direction therethrough, in concordantly controlled manner.

For instance, platen 13 may be arranged as an idler roller driven by a capstan roller system, such as one or more reversibly rotatable driving traction rollers acting against platen 13, to transport receiver 15, located therebetween, in forward and reverse directions through nip 14. Typically, one capstan roller is arranged at the feed (upstream) side of nip 14 and another is arranged at the takeup (downstream) side of nip 14 for movement of receiver 15 through nip 14 via the appropriately rotating capstan rollers as they concordantly drive platen 13.

Web 16 and receiver 15 are typically in the form of continuous longitudinal elements (strips or ribbons) arranged to move through nip 14 between their supply and takeup reels as shown. However, web 16 and receiver 15 may be provided in any suitable form for effecting the borderless printing. For instance, receiver 15 may be an individual cut sheet, e.g., an 8 ½" by 11" sheet of paper, supported for travel through nip 14 in known manner.

At the start of a printing run, receiver 15 is registered at nip 14 with a given color, e.g., yellow, frame 36 of web 16 to effect a first printing cycle in known manner. Head 11 is then moved to contact position and the cycle effected by energizing head 11 while conveying receiver 15 and web 16 in unison at proper uniform linear speed past the head to transfer yellow dye images from the web to a given receiver area.

In the second cycle, after moving head 11 to spaced position and receiver 15 back to starting position to reregister it with nip 14, head 11 is moved to contact position. Printing is effected by energizing head 11 while conveying receiver 15 forwardly with the next frame 36, e.g., of magenta dye, of web 16 in the same way as in the first cycle. Magenta dye images are transferred from web 16 to the same area of receiver 15 previously printed with yellow dye.

The third cycle is analogously effected to print the same receiver area with the next color dye, e.g., cyan dye. The three cycles transfer dye image pixels of each of the colors of web 16 successively to the same area of receiver 15 in a printing run.

In the case of a single color printing operation, web 16 contains a single color dye, and a single cycle is effected in a printing run. In this case, receiver motor 37 and linkage 38 are omitted from assembly 10, and platen motor 21, web motor 26 and receiver motor 30 operate concordantly for forward travel of web 16 and receiver 15 in unison to effect a given printing cycle or run.

Whether assembly 10 is arranged for multicolor printing, as shown, or single color printing, as just described, borderless thermal printing is effected to print dye image pixels selectively throughout each line of the given area of receiver 15 being printed in the cycle or run, i.e., from the first pixel position at the left side edge of receiver 15 to the last pixel position at the right side edge thereof. The full width of the entire given area of receiver 15 is thus printed to form a borderless print product.

As is clear from FIGS. 2 and 3, the bead, i.e., linear array, of heating elements 12 defines a printing width (head width) 41, which with the width 42 of platen 13 forms a nip width 43 along the common extent of head 11 and platen 13 at printing nip 14. Platen width 42 is typically wider than head width 41, but head width 41 may equal or exceed platen width 42. In any case, the coextensive portions of head width 41 and platen width 42 define nip width 43.

The width 45 of web 16 may be narrower or wider than, or may equal, head width 41, platen width 42 and/or nip width 43. The width 44 of receiver 15 may be equal to or narrower than the widths of the other parts. However, receiver 15 generally has the narrowest width to assure its borderless printing, and thus width 44 is narrower than nip width 43 and web width 45.

During borderless printing of each line on receiver 15, the operation is subject to the problem of lateral overprinting on the adjacent circumferential portions of platen 13 extending laterally beyond the side edges of receiver 15. It is also subject to the related problem of underprinting receiver 15 so as to leave an undesired border thereon. Another problem is that the dimensional tolerances of the widths of the pertinent parts introduce a source of overprinting or underprinting error, given the minute dimensions of an image pixel (e.g., 0.003 inch length and 0.003 inch height).

If less elaborate software is used to operate control circuit 20, overprinting on platen 13 or underprinting of receiver 15 can occur. In the one case, line printing may start before the first pixel position and/or terminate after the last pixel position on receiver 15, causing overprinting on the left and/or right side portions of the circumference of platen 13 adjacent the receiver side edges. In the other case, line printing may start after the first pixel position and/or terminate before the last pixel position, leaving an unprinted border on receiver 15 at the first pixel position or the first few pixel positions and/or at the last pixel position or the last few pixel positions.

Even using more elaborate software to operate control circuit 20 for precise printing of each line on receiver 15 from the first pixel position at its left side edge to the last pixel position at its right side edge, the vagaries of the dimensional tolerances of nip width 43, web width 45 and receiver width 44 are such that platen overprinting or receiver underprinting can still occur.

For instance, given the minute dimension of an image pixel, even with software sufficiently elaborate for precisely printing receiver width 44 from its first to last pixel positions, if web width 45 is narrower than receiver width 44 at any point, the first or first few pixel positions and/or the last or last few pixel positions on the line printed at that point, will be beyond the range of web 16, leaving an undesired border on receiver 15. If receiver width 44 is narrower at any point than its width as programmed by the software while web width 45 remains wider than receiver width 44, overprinting on platen 13 will still occur.

These problems are avoided according to the invention by providing assembly 10 with extension member 17, which is disposed at nip 14 between receiver 15 and platen 13 to protect platen 13 from overprinting. As is clear from FIGS. 2 and 3, width 46 of member 17 is wider than receiver width 44 and sufficient to the exceed the extend of nip width 43 occupied by web 16. Member 17 is disposed in nip 14 so that its sides extend laterally beyond the sides of receiver 15 as well as beyond the extend of nip width 43 occupied by web 16 so as to protect the adjacent sides of platen 13 thereunder from overprinting.

Receiver width 44 is smaller than both nip width 43 and web width 45, and receiver 15 is arranged to travel through nip 14 within the lateral confines of nip width 43. Web width 45 need only be sufficient for web 16 to occupy at least a portion of web width 43, and thus may be smaller or larger than, or equal to, nip width 43, while being larger than receiver width 15. Web 16 is arranged to travel through nip 14 with its sides extending laterally beyond the sides of receiver 15, and thus in facing relation to the adjacent side portions of platen 13.

When web width 45 is smaller than nip width 43, as is the case shown in FIGS. 2 and 3, web 16 occupies a sufficient portion of nip width 43 for dye transfer to receiver 15 along the full width of receiver 15 from its first to its last pixel position to effect borderless printing. The same is true when web width 45 is equal to or larger than nip width 43. In all such cases, as member width 46 is sufficient to exceed the extend of nip width 43 occupied by web 16, its sides extend laterally beyond both the sides of receiver 15 and the extend of nip width 43 occupied by web 16.

Hence, the side portions of member 17 that extend beyond the side portions of web 16 within the confines of nip width 43, protect the side portions of platen 13 adjacent the side edges of receiver 15 from lateral overprinting, in that the overprinting is received on the member side portions instead, in the same way that receiver 15 receives the borderless printing. Providing member 17 in assembly 10 according to the invention prevents lateral overprinting on platen 13 in all cases, so long as the software used is sufficient to assure that head 11 operates to energize the full linear range of heating elements 12 corresponding to all pixel positions of receiver 15 from its first to last pixel position.

Less elaborate software can be used that contemplates overprinting at one or more pixel positions to the left of the left side edge of receiver 15 and thus to the left of the first pixel position, and overprinting at one or more pixel positions to the right of the right side edge of receiver 15 an thus to the right of the last pixel position. This assures borderless printing of receiver 15, regardless of its selected width 44. On switching to a wider width receiver 15, and appropriate adjustment of the software to accommodate the new receiver width 44, the same safe result is assured.

Moreover, due to the location of member 17, variation sin the dimensional tolerances of the pertinent parts, e.g., local variation in the relative widths of receiver 15, web 16 and even member 17 will not adversely affect the result. This is because member 17 has a width 46 sufficient to exceed the extent of nip width 43 occupied by width 45 of web 16, so as to receive any overprinting thereon and simultaneously protect the underlying portions of platen 13 from overprinting.

Typically, member 17 is fed from a supply reel 32 to a takeup reel 33, driven by a motor 34 via a drive linkage 35 (shown schematically in FIG. 1), for forward travel along path 23 through nip 14 between receiver 15 and platen 13. Motor 34 is arranged for common operation with platen motor 21, web motor 25 and receiver motor 30 at concordant sped for uniform forward movement of member 17 in unison with web 16 and receiver 15 through nip 14, and is disengaged along with web motor 26 and receiver motor 30 when platen motor 21 and receiver motor 37 are operated for reverse movement of receiver 15, as earlier described.

As overprinting on member 17 is relatively slight, compared to the borderless printing of receiver 15, when member 17 has been completely fed from supply reel 32 to takeup reel 33, the reels can be switched for reuse of member 17 one or more times. By providing supply reel 32 with a separate motor (not shown), for rewinding member 17 from takeup reel 33 thereto, similar to the arrangement of motors 30 and 37 for receiver 15, member 17 can be rewound from reel 33 to reel 32 for reuse instead of switching the reels.

Also, a modified member 17' (shown per dashed line in FIG. 1), formed as an endless belt mounted on rollers corresponding to reels 32 and 33, may be used in place of member 17. In this case, the roller corresponding to takeup reel 33 is driven by member motor 34 in like manner to the driving of reel 33.

Member motor 34 is connected to control circuit 20 (by means not shown) for concordantly controlled operation in the same way as platen motor 21, web motor 26 and receiver motor 30. Motor 34 is also typically a stepper motor. Any other means may be used to move member 17 (or member 17') in unison with receiver 15 and web 16 forwardly through nip 14 in concordantly controlled manner.

Member 17 operates in the same way as web 16 and receiver 15 during a printing run, to print different colors from web 16 on receiver 15 in successive cycles in a multicolor operation, or to print a single color from web 16 in a single cycle printing run in a single color operation, as described above.

Like web 16 and receiver 15, member 17 is typically a continuous longitudinal element (strip or ribbon) arranged to move through nip 14 between its supply and takeup reels as shown. However, member 17, like web 16 and receiver 15, may be in any suitable form for effecting borderless printing on receiver 15 via head 11 and web 16, while protecting platen 13 from overprinting via member 17. For instance, besides using modified member 17' in endless belt form, member 17 may form a removable protective cover on platen 13 so as to travel through nip 14 as platen 13 rotates.

Member 17 may be any sheeting material such as paper or fabric (cloth) that is capable of receiving overprinted individual dye image pixel deposits, and locally retaining them against migration outwardly of its side edges or through its cross section from its receiving surface facing web 16 to its underside surface supported on platen 13, analogously to the borderless printing reception of such dye pixel deposits by receiver 15.

Whether assembly 10 is arranged for multicolor printing, as shown in FIGS. 1 to 3, or single color printing, borderless thermal printing is effected per the method of the invention, with lateral overprinting on member 17 while preventing such overprinting on platen 13. Because of the assembly arrangement of the invention, no dye image pixel deposits will occur on platen 13, yet borderless printing on receiver 15 is guaranteed, i.e., printing of dye pixels across its full width from its first to last pixel positions.

Uniform density pixel printing is assured because there is no build up of dye deposits on platen 13 that can cause unevenness at the side edges of a given receiver 15, or contaminate or otherwise disturb proper operation of heating elements 12, as explained above. To enhance such density uniformity, each of web 16, receiver 15 and member 17 desirably has a uniform thickness along its width, so that nip 14 defines a uniform height gap between the linear bead of head elements 12 and platen 13 along nip width 43 for applying a uniform mechanical line contact force by head 11 to urge web 16, receiver 15 and member 17 against platen 13.

Figure 4:
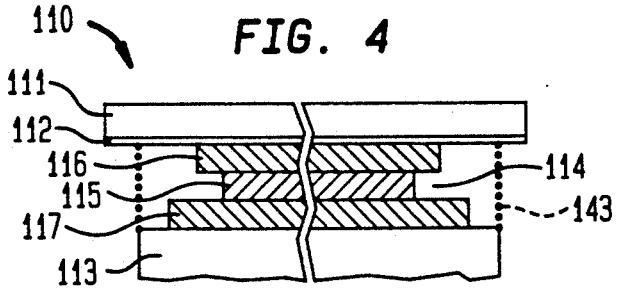
FIG. 4 is a view similar to FIG. 2, of a second embodiment of the assembly having a second set of widths for such parts.

Referring now to FIG. 4, there is shown a second assembly embodiment with a second set of widths for the pertinent parts of the embodiment of FIGS. 1 to 3, having the same numbers preceded by a 1 (100 series numbers), including an assembly 110, head 111, bead of heating elements 112, platen 113, nip 114, receiver 115, web 116, member 117 and nip width 143. The width of head 111 exceeds that of platen 113, and nip width 143 exceeds the width of web 116. While the width of web 116 exceeds that of receiver 115, the width of member 117 exceeds that of web 116.

Figure 5:
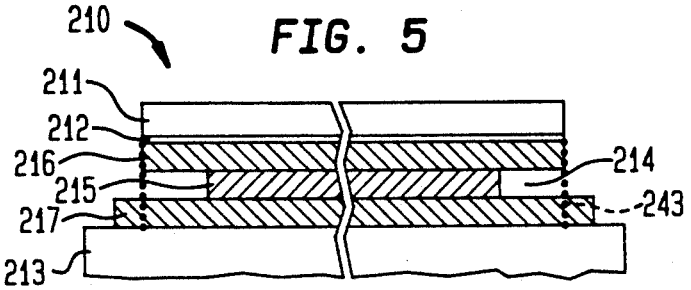
FIG. 5 is a view similar to FIG. 2, of a third embodiment of the assembly having a third set of widths for such parts.

Referring now to FIG. 5, there is shown a third assembly embodiment with a third set of widths for the pertinent parts of the embodiment of FIGS. 1 to 3, having the same numbers preceded by a 2 (200 series numbers), including an assembly 210, head 211, bead of heating elements 212, platen 213, nip 214, receiver 215, web 216, member 217 and nip width 243. The width of platen 213 exceeds that of head 211, and the width of head 211 equals that of web 216, so that the width of web 216 equals nip width 243. While the width of web 216 exceeds that of receiver 215, the width of member 217 exceeds the widths of web 216, head 211 and nip width 243.

Figure 6:
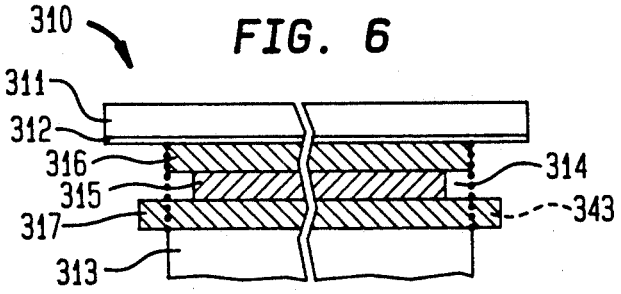
FIG. 6 is a view similar to FIG. 2, of a fourth embodiment of the assembly having a fourth set of widths for such parts.

Referring now to FIG. 6, there is shown a fourth assembly embodiment with a fourth set of widths for the pertinent parts of the embodiment of FIGS. 1 to 3, having the same numbers preceded by a 3 (300 series numbers), including an assembly 310, head 311, bead of heating elements 312, platen 313, nip 314, receiver 315, web 316, member 317 and nip width 343. The width of head 311 exceeds that of platen 313 and web 316, while the width of web 316 equals that of platen 313, so that the width of web 316 equals nip width 343. While the width of web 316 exceeds that of receiver 315, the width of member 317 exceeds that of web 316 and platen 313 and is only exceeded by the width of head 311.

Figure 7:
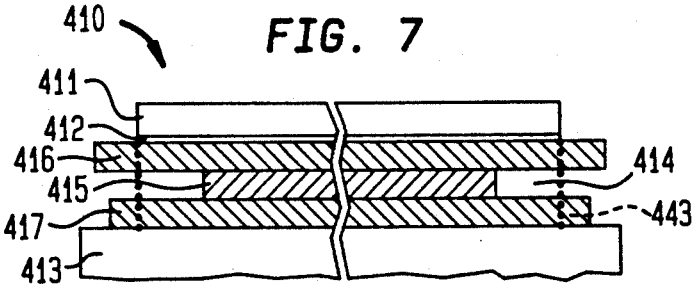
FIG. 7 is a view similar to FIG. 2, of a fifth embodiment of the assembly having a fifth set of widths for such parts.

Referring now to FIG. 7, there is shown a fifth assembly embodiment with a fifth set of widths for the pertinent parts of the embodiment of FIGS. 1 to 3, having the same numbers preceded by a 4 (400 series numbers), including an assembly 410, head 411, bead of heating elements 412, platen 413, nip 414, receiver 415, web 416, member 417 and nip width 443. The width of platen 413 exceeds that of web 416, and the width of web 416 exceeds that of head 411, so that the width of web 416 exceeds nip width 443. While the width of web 416 exceeds that of member 417, the width of member 417 exceeds that of receiver 415 and nip width 443.

Figure 8:
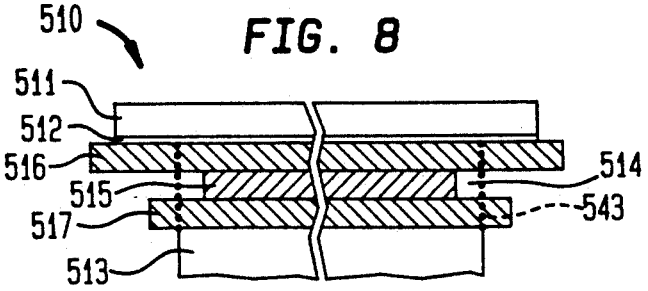
FIG. 8 is a view similar to FIG. 2, of a sixth embodiment of the assembly having a sixth set of widths for such parts.

Referring now to FIG. 8, there is shown a sixth assembly embodiment with a sixth set of widths for the pertinent parts of the embodiment of FIGS. 1 to 3, having the same numbers preceded by a 5 (500 series numbers), including an assembly 510, head 511, bead of heating elements 512, platen 513, nip 514, receiver 515, web 516, member 517 and nip width 543. The width of web 516 exceeds that of head 511, and the width of head 511 exceeds that of platen 513, forming a nip width 543 exceeded by the width of web 516. While the width of web 516 exceeds that of member 517, the width of member 517 exceeds that of receiver 515 and nip width 543.

In the first and second embodiments, the member width and nip width exceed the web width. In the third and fourth embodiments, the member width exceeds the web width which equals the nip width. In the fifth and sixth embodiments, the member width and web width exceed the nip width. Thus, the member width exceeds the nip width when the web width is at least as large as the nip width (third to sixth embodiments), and exceeds the web width when the web width is smaller than the nip width (first and second embodiments). The receiver has the narrowest width for the reasons noted above.

Accordingly, borderless printing on the image receiver is guaranteed by lateral overprinting on the extension member while simultaneously preventing overprinting on the underlying portions of the platen within the range of the printing nip width. As the nip width determines the range of printing along a line of printing corresponding to the linear array of heating elements, and the extension member width either exceeds the nip width or donor web width, no lateral overprinting of dye image deposits on the printing platen can occur. Less elaborate software can thus be used in known manner for the borderless printing operation.

There is no need to use elaborate software to control the borderless printing, nor to tape the platen or change it where a wider width receiver is to be printed, for protecting against non-uniform image pixel printing on the receiver due to underlying dye deposits on the platen, or associated contamination, and possible misalignment, of the heating elements.

As contemplated herein, "dye" refers to a normally solid form color substance (transfer dye) that is capable of thermal transfer by diffusion, sublimation or the like, from the donor web as carrier to the image receiver, in response to heat energy applied thereto by the individual heating elements of a thermal printing head. This solid form "dye" is distinct and different from liquid form colorant such as liquid ink used in nonthermal printing.

Accordingly, it can be appreciated that the specific embodiments described are merely illustrative of the general principles of the invention. Various modifications may be provided consistent with the principles set forth.

What is claimed is:

1. A borderless thermal printing assembly for printing images across a width of an image receiver having two side edges, from one of said edges to the other of said side edges thereof, the assembly comprising:

(a) a thermal printing head having a linear array of energizable heating elements, and a platen arranged to form a printing nip with the head defining a nip width;

an image receiver having a width smaller than the nip width and arranged to travel through the nip, and a donor web of heat transferable image imparting substance defining two donor web sides and which define a width between such donor web sides larger than the receiver width and sufficient to occupy at least a portion of the nip width, and arranged to travel through the nip between the head and the receiver with the sides of the donor web extending laterally beyond the side edges of the receiver in facing relation to the platen and with the donor web occupying at least a portion of the nip width; and an extension member defining extension member sides which have a width larger than the receiver width and the nip width occupied by the donor web, and disposed at the nip between the receiver and the platen with the sides of the extension member extending laterally beyond the side edges of the receiver and correspondingly beyond the nip width occupied by the donor web;

whereby to effect by way of heating from the head, donor web borderless printing on the receiver and lateral overprinting on the extension member adjacent the side edges of the receiver while preventing lateral overprinting on the platen.

2. The assembly of claim 1 wherein the web width is at least as large as the donor nip width and the extension member width exceeds the nip width.

3. The assembly of claim 1 wherein the donor web width is smaller than the nip width and the extension member width exceeds the web width.

4. The assembly of claim 1 wherein the extension member is arranged to travel through the nip.

5. The assembly of claim 4 wherein the receiver, donor web and extension member are arranged to travel in unison through the nip to effect the printing and overprinting.

6. The assembly of claim 5 wherein the receiver, donor web and extension member are longitudinal elements.

7. A borderless thermal printing assembly for printing images across a width of an image receiver having two side edges from one of said side edges to the other of said side edges thereof, the assembly comprising:

a thermal printing head having a linear array of energizable heating elements defining a printing width, and a platen arranged to form a printing nip with the head printing width defining a nip width;

an image receiver having a width smaller than the nip width and arranged to travel through the nip, and a donor web of heat transferable image imparting substance defining two donor web sides which define a width between such donor web sides larger than the receiver width and at least as large as the nip width, and arranged to travel through the nip between the head and the receiver with the sides of the donor web extending laterally beyond the side edges of the receiver in facing relation to the platen and with the donor web occupying the nip width; and an extension member defining extension member sides which define a width larger than the receiver width and larger than the nip width, and disposed at the nip between the receiver and the platen with the sides of the extension member extending laterally beyond the side edges of the receiver and correspondingly beyond the nip width;

whereby to effect by way of heating from the head, donor web borderless printing on the receiver and lateral overprinting on the extension member adjacent the side edges of the receiver while preventing lateral overprinting on the platen.

8. A borderless thermal printing assembly for printing images across a width of an image receiver having two side edges from one of said side edges to the other of said side edges thereof, the assembly comprising:

a thermal printing head having a linear array of energizable heating elements defining a printing width, and a platen arranged to form a printing nip with the head printing width defining a nip width;

an image receiver having a width smaller than the nip width and arranged to travel through the nip, and a donor web of heat transferable image imparting substance defining two donor web sides which define a width between such donor web sides larger than the receiver width and smaller than the nip width, and arranged to travel through the nip between the head and the receiver with the sides of the donor web extending laterally beyond the side edges of the receiver in facing relation to the platen and with the sides of the nip width extending correspondingly beyond the sides of the donor web; and an extension member defining extension member sides which define a width larger than the receiver width and larger than the donor web width, and disposed at the nip between the receiver and the platen with the sides of the extension member extending laterally beyond the side edges of the receiver and correspondingly beyond the sides of the donor web;

whereby to effect via heating from the head, donor web borderless printing on the receiver and lateral overprinting on the extension member adjacent the side edges of the receiver while preventing lateral overprinting on the platen.

9. A method of borderless thermal printing for printing images across a width of an image receiver having two side edges from one of said side edges to the other of said side edges thereof, the method comprising the steps of:

providing:

a) a thermal printing head having a linear array of energizable heating elements, an a platen arranged to form a printing nip with the head defining a nip width;

b) an image receiver having a width smaller than the nip width and arranged to travel through the nip and a donor web of heat transferable image imparting substance defining two donor web sides and which define a width between such donor web sides larger than the receiver width and sufficient to occupy at least a portion of the nip width, and arranged to travel through the nip between the head and the receiver wit the sides of the donor web extending laterally beyond the sides of the receiver in facing relation to the platen and with the donor web occupying at least a portion of the nip width; and c) an extension member defining extension member sides which define a width larger than the receiver width and sufficient to exceed the extend of the nip width occupied by the donor web, and disposed at the nip between the receiver and the platen with the sides of the extension member extending laterally beyond the side edges of the receiver and correspondingly beyond the extend of the nip width occupied by the donor web; and effecting by way of heating from the head, donor web borderless printing on the receiver and lateral overprinting on the extension member adjacent the side edges of the receiver while preventing lateral overprinting on the platen.

* * * * *